US005871304A

United States Patent [19]

Quinn et al.

[11] Patent Number: 5,871,304

[45] Date of Patent: Feb. 16, 1999

[54] PRECAST PREROTATION BASIN SYSTEM

[75] Inventors: Joel Quinn, South Jordan; Eric Maass, Salt Lake City; David P. Borrowman, Murray, all of Utah

[73] Assignee: EnviroTech Pumpsystems, Inc., Salt Lake City, Utah

[21] Appl. No.: 846,125

[22] Filed: Apr. 25, 1997

Related U.S. Application Data

[60] Provisional application No. 60/016,329, Apr. 25, 1996.

[51] Int. Cl.[6] ..... F15C 1/16

[52] U.S. Cl. ..... 405/52; 137/812; 405/40; 405/53; 405/303

[58] Field of Search ..... 405/36, 39, 40, 405/52, 53, 303; 166/242.9; 52/302.3; 137/565, 812, 833, 362

[56] References Cited

U.S. PATENT DOCUMENTS

| | | | |
|---|---|---|---|
| 3,708,239 | 1/1973 | Stahle | 415/1 |
| 4,298,294 | 11/1981 | Zimmerman | 405/37 |
| 4,661,047 | 4/1987 | Weis | 405/52 X |
| 4,822,213 | 4/1989 | Grace et al. | 405/303 |
| 5,248,219 | 9/1993 | Heiler, Jr. | 405/52 |
| 5,249,930 | 10/1993 | Pacquesi | 417/313 |
| 5,419,655 | 5/1995 | Phillips et al. | 405/36 X |
| 5,455,804 | 10/1995 | Holmes et al. | 137/812 X |
| 5,496,133 | 3/1996 | Sciarretti | 405/36 X |
| 5,507,628 | 4/1996 | Masse et al. | 417/360 |
| 5,551,797 | 9/1996 | Sanford | 405/36 |
| 5,687,766 | 11/1997 | Weakley | 137/812 |

OTHER PUBLICATIONS

Brochure entitled "Wemco Hidrostal Immersible Pumps"—1991.

Brochure entitled Wemco Hidrostal Prerostal the System for Pumping Oily Water—1992.

*Primary Examiner*—Tamara L. Graysay
*Assistant Examiner*—Tara L. Mayo
*Attorney, Agent, or Firm*—Trask, Britt & Rossa

[57] ABSTRACT

A precast prerotation basin system for use in a wet well for removing water or fluid therefrom is disclosed which comprises a prefabricated, three-dimensional body having a prerotation basin and fluid entrance channel. The precast prerotation basin presents an improvement over prior methods of forming prerotation basins downhole in a wet well because the basin system of the present invention is prefabricated, easily transportable and can be placed in a wet well without the need for providing a cement casing or floor beforehand. The precast prerotation basin of the present invention is pre-structured for accurate alignment of a centrifugal pump therein and eliminates the cost and inaccuracies of forming prerotation basins from molding cement downhole.

16 Claims, 4 Drawing Sheets

PRECAST PEROTATION BASIN SYSTEM

This application claims the benefit of U.S. Provisional Application No. 60/016,329, filed Apr. 25, 1996.

BACKGROUND OF THE INVENTION

1. Field of the Invention

This invention relates to wet wells and sump basins which are used in a variety of industries and settings to remove fluid from a defined area, and specifically relates to precast basins.

2. Statement of the Art

Wet wells are commonly used in a variety of industries including, for example, mining, oil drilling, core drilling, sewage collection, industrial sites, municipal waste systems and water run-off from collection areas to concentrate unwanted fluid in a defined area and pump it away from that defined area. Wet wells typically include an enclosed area which is positioned below ground level and is structured to receive a fluid therein. A sump basin is positioned at the bottom of the enclosed area. A pump or pump system is positioned in or near the sump basin to pump fluid out of the wet well. A discharge pipe is usually connected to the pump to carry the pumped fluid out of and away from the defined area.

A wet well may also comprise a prerotation basin into which the inlet of the pump is positioned. A weir surrounds the prerotation basin and a fluid channel is formed tangentially to the prerotation basin to introduce fluid into the prerotation basin and the pump at an angle. Under high fluid inflow into the wet well (i.e., when the level of fluid in the wet well is higher than the weir of the wet well), the pump operates in a conventional manner to pump water out of the wet well. However, when the fluid level is low, the weir directs the fluid into a forebay which is positioned at the entrance to the fluid channel. The forebay and fluid channel direct the fluid into the prerotation basin at an angle which modifies the performance of the pump, resulting in a lower head capacity and reduced energy consumption by the pump. As a result, the pump may operate without complicated speed controls, and fluid inflow is matched to fluid outflow through the pump.

Most prerotation wet wells are formed by one of two methods. In one method, a hole or cavity is formed, or excavated, below ground and concrete is poured into the hole or cavity to form the sump basin, the weir, the fluid channel and the forebay. In the other method, concrete is poured into the excavated hole or cavity, but a void is left in the concrete for placement of a sump basin. A prefabricated sump basin having a partial weir is then lowered into the concrete formation and is grouted into place.

Several disadvantages are inherent in either means of forming a prerotation wet well. Both methods require that the hole or cavity be completely dry before the concrete can be poured, a pre-condition which is very difficult to achieve in many settings. Both methods require one or more workmen to enter the cavity after the concrete is poured to form certain elements of the prerotation wet well, including the fluid channel, the weir and the forebay. There are critical factors which impact the optimal operation of the prerotation wet well, including the angle, depth, width and side wall slope of the fluid channel, the height of the weirs, the depth and diameter of the prerotation basin and the placement of the forebay, all of which demand that the workmen exercise particular skill while working below ground in a relatively dark and confined space. Numerous and significant errors may occur as a result. Even with a prefabricated basin as previously described, a workman must enter the concrete enclosure of the prerotation wet well to grout in the prefabricated basin.

Once the concrete prerotation wet well of prior art systems is formed, it may be discovered that the void left for the prefabricated basin was improperly positioned or sized, and ameliorative steps must be taken to correct the situation. Also, the pump and fast out (the equipment used to raise the pump out of the hole) may often be positioned relative to the prerotation wet well prior to the concrete being poured, and the pump is later discovered to be misaligned with the sump basin, or vice versa. It may also be discovered that the fast out anchors (usually holes drilled in the concrete) formed near the basin are incorrectly placed or incorrectly positioned in height relative to the prerotation basin so that the pump is positioned too high in the basin.

These and other disadvantages of conventional prerotation wet well construction are overcome in the present invention.

BRIEF SUMMARY OF THE INVENTION

In accordance with the present invention, a precast prerotation basin system is formed as a prefabricated, three-dimensional body having a prerotation basin sized to receive the inlet of a pump, a fluid entrance channel, a weir and a transport structure which facilitates movement of the precast prerotation basin from place to place. The precast prerotation basin system of the present invention is formed from any suitable material which may be formed into a selected shape, such as fiberglass, thermosetting plastics, acrylics, other hardened synthetics or metals. The precast prerotation basin system may be formed by casting on a form, by vacuum formation or other suitable methods. The precast prerotation basin system has the advantage over conventional prerotation wet well structures of being preformed to a selected size, configuration and dimension which is specific to a pump size and type and/or specific to the requirements of the particular pumping application. Thus, knowing the size of the pump, and other parameters of the specific application, the correct size and configuration of the precast prerotation basin can be selected and installed. The preformed structure thereby eliminates the inaccuracies of workmanship experienced with prerotation wet wells produced by shaping pre-poured concrete.

The precast prerotation basin system of the present invention is structured to be lowered into a pre-existing hole or cavity without the need for pumping the liquid (e.g., water) out first. The precast prerotation basin system may even be lowered in over a pre-existing concrete basin. The precast prerotation basin system may be filled with a ballast material which enables the structure to be firmly anchored at the bottom of the hole after being lowered in, and to remain stationary underwater. Any suitable ballast material may be used which provides sufficient weight to the structure to prevent buoyancy of the structure while submerged in the pumping fluid. A mixture of concrete and foam may be particularly suitable since the addition of foam lessens the dry weight of the precast structure, facilitating shipment, but the amount of foam is sufficiently small to avoid buoyancy of the structure while positioned underwater. Alternatively, the precast structure may be partially filled with a ballast material to limit the weight of the structure during shipment, and then the precast structure can be filled with additional ballast material on site, either before or after being lowered into the hole.

The precast prerotation basin system of the present invention has the further advantage of being removable from the hole, unlike conventional prerotation wet well systems or prefabricated sump basins. The transportability of the invention allows it to be moved from site to site. The cost of manufacturing the precast prerotation basin system is also much less than forming a prerotation wet well and basin from prepoured concrete. Because the precast structure can simply be lowered into the preexisting hole, off-line time is reduced and productivity is less affected. The precast prerotation basin of the present invention is a unitary structure which eliminates the need to pour part of the basin structure in concrete with the later addition of a prefabricated sump basin as is known in prior art systems. In addition, the precast structure is more accurately manufactured and allows the structure to be formed from a number of different materials which may be more suitable than concrete to the application requirements.

BRIEF DESCRIPTION OF THE SEVERAL VIEWS OF THE DRAWING

In the drawings, which illustrate what is currently considered to be the best mode for carrying out the invention.

DETAILED DESCRIPTION OF THE INVENTION

Figure 1:
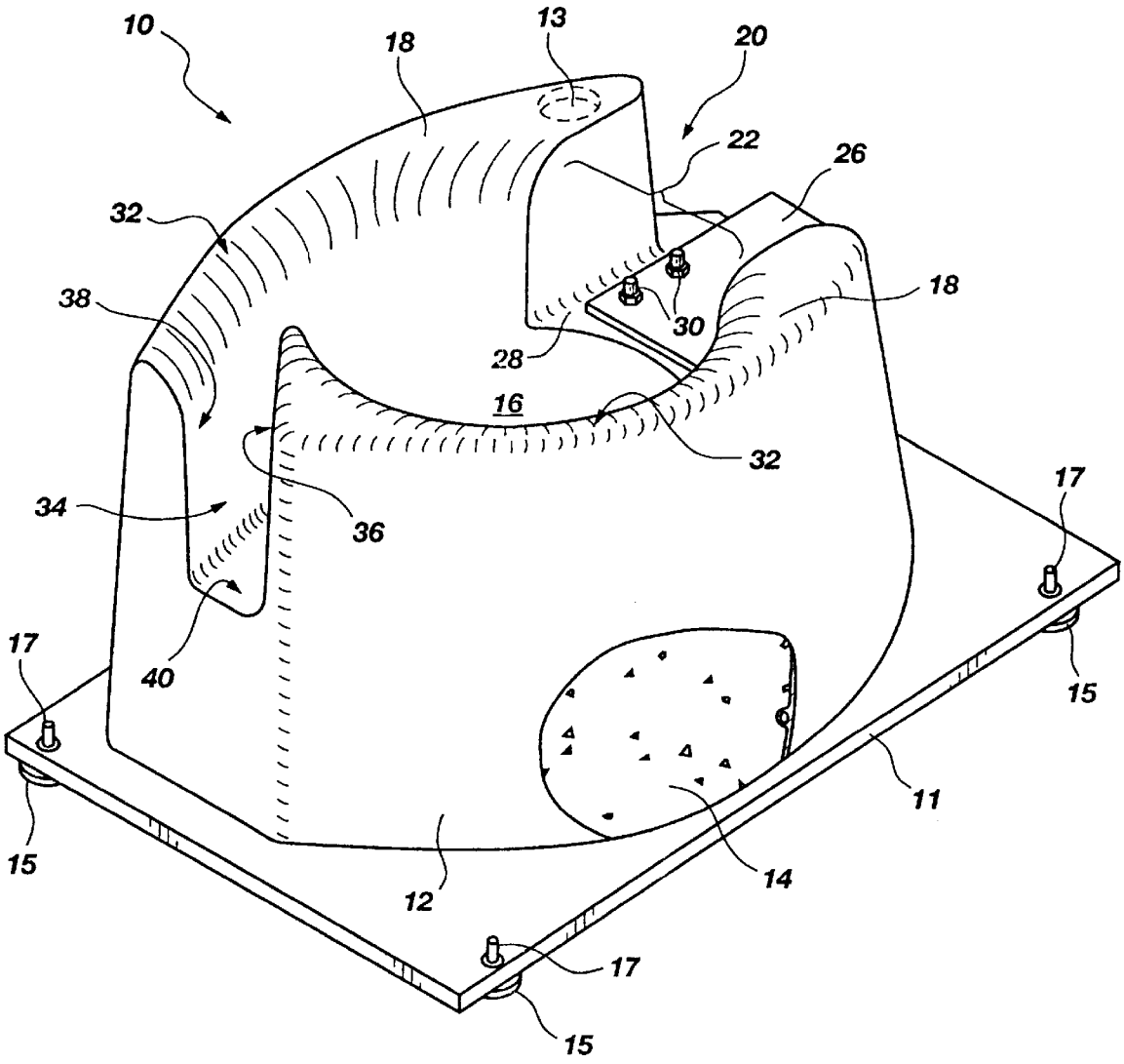
FIG. 1 is a perspective view of the precast prerotation basin of the present invention, shown attached to an anchoring plate.

An overall perspective view of the precast prerotation basin system 10 (hereinafter "basin system 10") of the present invention is shown in FIG. 1. The basin system 10 is a cast or formed structure which, preferably, may be a three-dimensional shell 12. The shell 12 may, for example, be formed by vacuum forming a suitable material on a model or by applying one or more coatings of fiberglass material on a model (not shown) which has been specifically configured with the required elements and dimensions. When cured, the shell 12 is removed from the model and the negative space or void remaining from removal of the model is filled with a permanent ballast material 14. The permanent ballast material may be any suitable material or combination of materials which provide the basin system 10 with sufficient weight to prevent buoyancy when submerged in the fluid to be pumped. The ballast material 14 also imparts strength to the shell 12 for mounting of a pump thereto. The ballast material may also include one or more materials of lighter weight which reduce the overall weight of the basin system 10, thereby enabling easier transport. A combination of fiberglass-reinforced concrete and foam may be particularly suitable.

Alternatively, as shown in FIG. 1, the shell 12 may be formed and then only partially filled with a temporary or permanent ballast material 14 in order to keep the weight of the basin system 10 to a minimum for transport. A plate 11 may then be attached to the bottom of the basin system 10. Once the basin system 10 arrives at the wet well site, the basin system 10 may be filled with additional ballast material through an aperture 13 (shown in phantom in FIG. 1) formed in the shell 12. The shell 12 may either be filled before lowering the basin system 10 into the hole, or the basin system 10 may be lowered into the hole and then filled through the aperture 13. The plate 11 attached to the basin system 10 may completely cover the bottom of the basin system 10, as suggested by FIG. 1, or may comprise, for example, planks of material arranged in parallel fashion in a manner similar to a pallet. The plate 11 may, most suitably, include adjustable leveler feet 15 having an adjustable pin screw 17 positioned on top of the plate 11 which may be turned by a suitable tool. Thus, when the basin system 10 is lowered to the bottom of the hole, the basin system 10 can be levelled or adjusted by turning the pin screws 17 with a tool lowered into the hole from ground level.

The formation of the basin system 10 previously described is but one possible means of preforming, casting or molding the present invention. For example, the preformed basin system 10 may be manufactured as a solid unit (i.e., no negative space left from formation on a mold) by pouring a suitable material into a negative mold of the basin system 10. Other equally suitable means may be used.

The basin system 10 is generally formed with a prerotation basin 16 which is sized in diameter and depth to accommodate a given pump capacity or a given pump size and/or type. The prerotation basin 16 is substantially surrounded by an upstanding wall 18 which acts as a weir 32 about the prerotation basin 16. The continuity of the wall 18 is interrupted by a fast out opening 20 which is sized in width 22 to receive a fast out structure 24 (FIG. 2) therein. The fast out opening 20 also serves as a transport structure which facilitates the movement of the basin system 10 from place to place. That is, the basin system 10 is shown in FIG. 1 with a mounting plate 26 positioned along the bottom 28 of the fast out opening 20, and anchor bolts 30 secure the mounting plate 26 thereto. The mounting plate 26 is attached to the formed shell 12 and assists in anchoring the shell 12 as the shell is inverted for filling with the ballast material 14. Once filled, the mounting plate 26 is attached to suitable rigging to assist in re-inverting the shell 12 to its proper orientation, as shown. The mounting plate 26 is removed prior to attachment of the fast out structure 24 (FIGS. 2 and 3) to the basin system 10.

Figure 2:
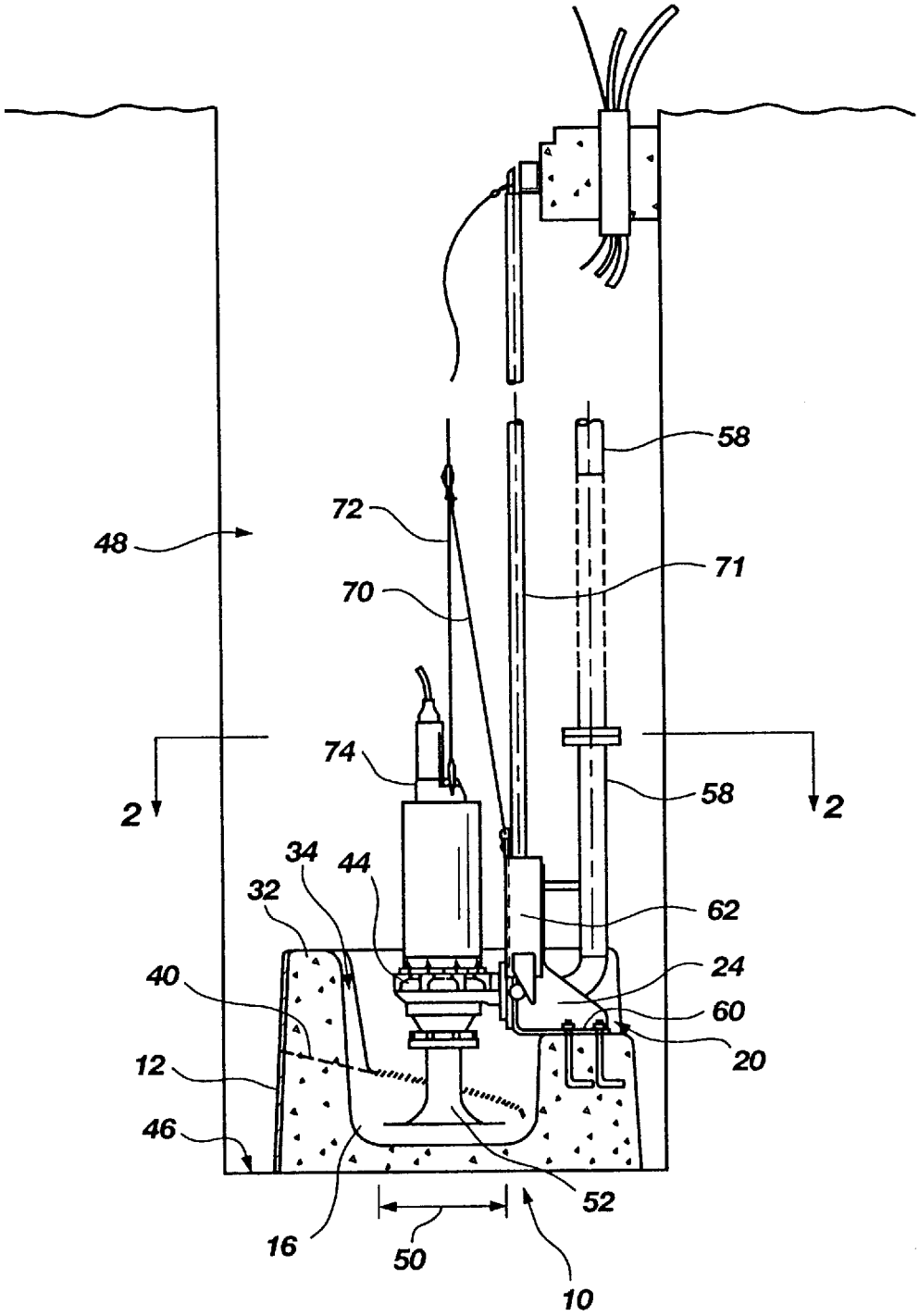
FIG. 2 is a side view showing positioning of the precast prerotation basin downhole and the mechanism for lowering a pump into position relative to the basin.

A fluid entrance channel 34 is also formed in the basin system 10 and is formed between facing wall surfaces 36, 38. The fluid entrance channel 34 is formed with a sloped floor 40 which directs fluid at a downward angle toward the prerotation basin 16. The fluid entrance channel 34 is also formed tangentially to the prerotation basin 16 to direct fluid at a tangential angle to the pump 44 (FIG. 2). Fluid in the prerotation wet well is directed into the fluid entrance channel 34 by the weirs 32.

Figure 3:
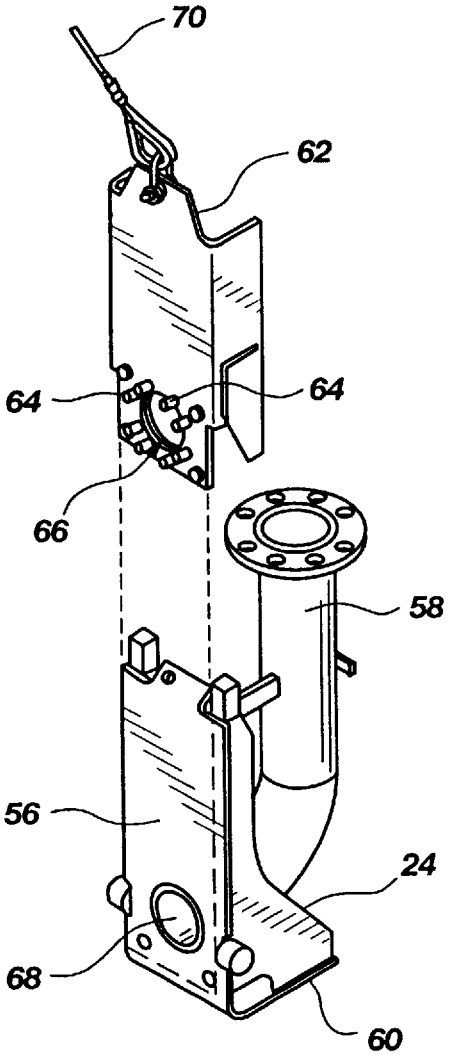
FIG. 3 is a perspective view of the fast out structure of the invention and a guide shoe for placing the fast out.

FIG. 2 more clearly illustrates one exemplar application of the basin system showing the relative positioning of the basin system 10 to the pump 44 and fast out structure 24 when lowered to the bottom 46 of an excavated hole 48. It can be seen that the prerotation basin 16 is sized in width 50 to accommodate the pump suction inlet 52 of the pump 44. The pump 44 is connected to the fast out structure 24 which is securely bolted to the fast out opening 20. The fast out structure 24, as also illustrated in FIG. 3, comprises an upright body 56 to which is attached a discharge pipe 58. A bottom plate portion 60 of the upright body 56 is sized to be received in the fast out opening 20 formed in the basin system 10 of the invention and the plate portion 60 is bolted to the fast out opening 20. A shield (not shown) is positioned between the fast out opening 20 and the fast out structure 24 to prevent fluid movement therebetween.

A guide shoe 62 is slidingly positionable over the upright body 56, as shown in FIGS. 2 and 3, and is structured with lugs or bolts 64 for secure attachment of the pump 44 thereto. The outlet of the pump 44 is aligned with the hole 66 formed in the guide shoe 62 when the pump is secured to the guide shoe 62. The hole 66 formed in the guide shoe 62 becomes aligned with the hole 68 formed in the upright body 56 when the guide shoe 62 is positioned over the upright body 56 so that fluid moving through the pump 44 is delivered to the discharge pipe 58 (FIG. 2). If necessary, the pump 44 can be quickly removed from the prerotation wet well by raising the cable 70 attached to the guide shoe 62. The guide shoe 62 may preferably be attached to a track 71 which guides the guide shoe 62 and pump 44 into and out of the hole 48. Another cable 72 may be attached to the motor housing 74 of the pump 44 to assist in pulling the pump 44 out of the hole 48. Notably, a fast out structure 24 and guide shoe 62, as previously described, may not be necessary in all applications in which the basin system may be employed. Any fixed structure may be attached to the fast out opening 20 for attachment of the pump 44 thereto.

Figure 4:
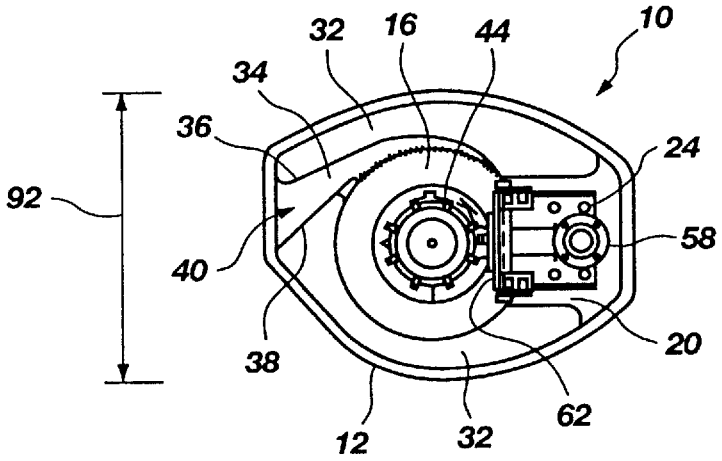
FIG. 4 is a plan view of the prerotation basin system shown in FIG. 2, taken at line 2—2.

The fast out opening 20 extends upwardly from the prerotation basin 16 a select distance to properly position the pump suction inlet 52 of the pump 44 in proper relation to the prerotation basin 16. The relative position of the fast out structure 24 and the pump 44 to the basin system 10 is also shown in FIG. 4, which also illustrates by a plan view the positioning of the fluid entrance channel 34 relative to the prerotation basin 16 and the pump 44. That is, the fluid entrance channel 34 is positioned tangentially to the prerotation basin 16 so that fluid enters the prerotation basin 16 at an angle to the pump 44. The downward angle of the floor 40 of the fluid entrance channel 34 can also be seen in FIG. 2 and the downward angle continues into the prerotation basin 16 to direct the flow of fluid at the proper angle and velocity toward the pump suction inlet 52 of the pump 44.

Figure 5:
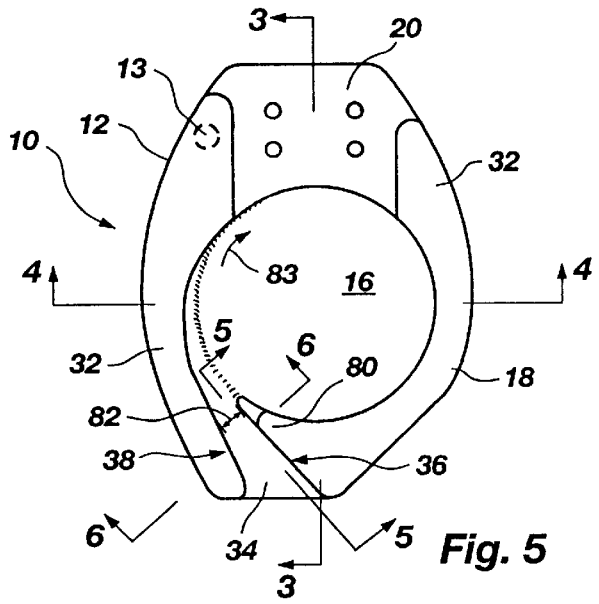
FIG. 5 is a plan view of the prerotation basin, shown without a pump, to illustrate the relative placement and configuration of the basin, fluid entrance channel and weir.

The relative size, configuration and dimensions of a precast prerotation basin system 10 of the present invention are shown more clearly in FIGS. 5–9 where the pump and fast out structure are removed. The plan view of the basin system 10 shown in FIG. 5 illustrates that the substantially continuous wall 18 of the basin system curves inwardly to form an inward channel section 80. The inward channel section 80 provides a wall surface 36 which is positioned in alignment with and spaced apart from an opposing wall surface 38 to form the sides of the fluid entrance channel 34. Due to the positioning and angle of the inward channel section 80, the fluid entrance channel 34 narrows in width 82 as it approaches the prerotation basin 16. The narrowing width of the fluid entrance channel 34 increases the speed of the fluid moving therethrough and initiates rotation of the fluid in the prerotation basin 16 in the direction of arrow 83. The surrounding substantially continuous wall 18 forms a weir 32 which surrounds the prerotation basin 16 and directs fluid into the fluid entrance channel 34.

Figure 6:
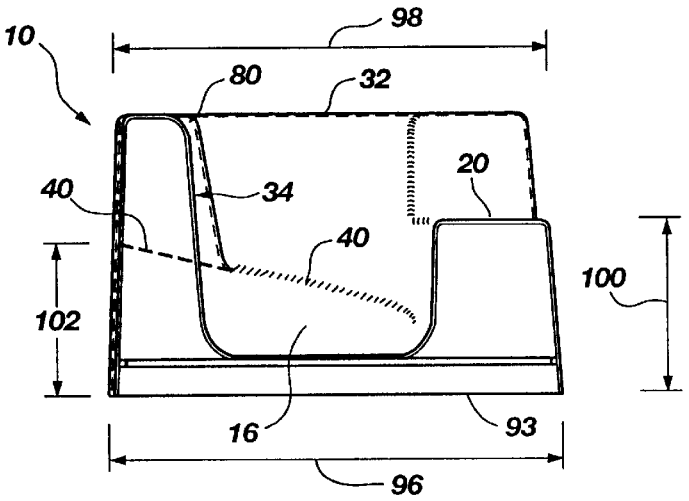
FIG. 6 is a view in cross section of the prerotation basin shown in FIG. 5, taken at line 3—3, showing the basin and the fluid entrance channel.

FIG. 6 illustrates a cross sectional view of the basin system 10 shown in FIG. 5 taken at line 3—3, and provides the same cross sectional view shown in FIG. 2, but with the pump and fast out structure removed. Again, the downward slope of the floor 40 of the fluid entrance channel 34 is shown as it enters into the prerotation basin 16. It can be seen that the basin system 10 is formed such that the floor 40 of the fluid entrance channel 34 curves around the continuous wall 18 until it blends into the basin 16, thereby directing fluid into the prerotation basin 16.

Figure 8:
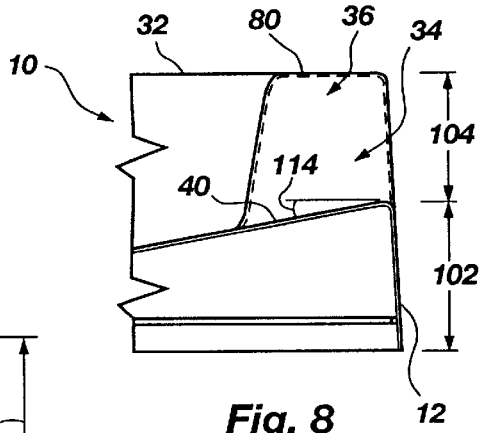
FIG. 8 is a view in cross section of the prerotation basin shown in FIG. 5, taken at line 5—5, and showing the slope of the fluid entrance channel.
Figure 7:
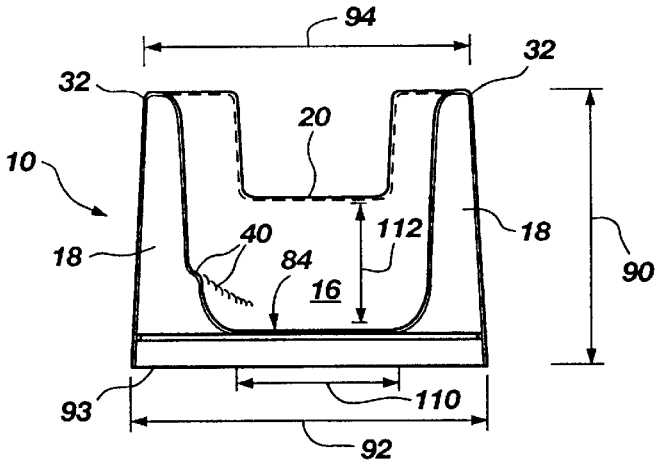
FIG. 7 is a view in cross section of the prerotation basin shown in FIG. 5, taken at line 4—4, showing the relative size and positioning of the basin to the fast out opening.

FIG. 7 illustrates a cross sectional view of the basin system 10 shown in FIG. 5, taken at line 4—4. The relative position of the fast out opening 20 can be seen in comparison to the prerotation basin 16. The bottom 84 of the prerotation basin 16 relative to the weir 32 can also be seen. FIG. 8 illustrates a partial view of the basin system 10 showing a cross sectional view of the fluid entrance channel 34 as shown in FIG. 5, taken at line 5—5. The downward slope of the bottom 40 of the fluid entrance channel 34 can also be seen.

Figure 9:
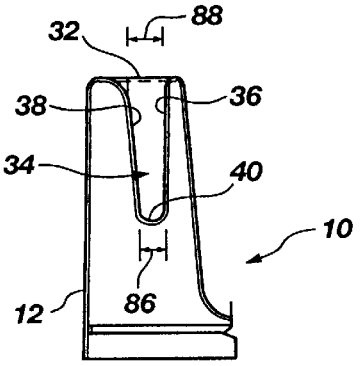
FIG. 9 is a view in cross section of the prerotation basin shown in FIG. 5, taken at line 6—6, showing the width of the fluid entrance channel.

FIG. 9 is a partial view of the basin system 10 showing a cross sectional view of the fluid entrance channel 34 illustrated in FIG. 5, taken at line 6—6. It can be seen from FIG. 9 that the side walls 36, 38 of the fluid entrance channel 34 may be sloped, or slightly angled inwardly toward each other so that the width 86 of the fluid entrance channel 34 near the floor 40 is of smaller dimension than the width 88 of the fluid entrance channel 34 near the weir 32. The sloping of the side walls 36, 38 of the fluid entrance channel 34 as described is beneficial to proper channelling of fluid into the prerotation basin 16. Particularly, the slope of the side walls 36, 38 and the downward slope of the floor 40 of the fluid entrance channel 34 increase the speed of the fluid as it enters the prerotation basin 16. It also causes the fluid to rotate in the direction of the pump 44 so that the pump 44 works more efficiently by reducing pump flow to remove liquid from the wet well at a slower rate. This aids in skimming the top of pumped fluid.

The precast prerotation basin system of the present invention may be made in any suitable size or variation of dimension as may be dictated by the type of influent being processed in the prerotation wet well, the type and size of pump being used, the volume of fluid that is likely to be processed through the wet well, whether skimming is a necessary or desirable part of the application processes, and many other possible parameters or conditions of the particular application. The drawings herein should not be interpreted as limiting the size, dimension or configuration of the basin system 10 since the dimension, size and configuration of the basin system 10 is dependent upon a multiplicity of factors.

By way of example only, the dimensions of a precast prerotation basin system which is designed for use with a standard centrifugal pump and designed for pumping water from a drainage area may be as follows: The overall height 90 (FIG. 7) of the basin system 10 is approximately thirty inches. The width 92 (FIG. 7) of the basin system 10, measured at the bottom 93 thereof, and measured from one wall 18 to the opposing wall 18, is approximately thirty-nine inches. The substantially continuous wall 18 may slope inwardly and upwardly toward the central vertical axis of the basin system 10, as shown in FIGS. 6 and 7. Therefore, the width 94 (FIG. 7) of the basin system 10 measured at the top thereof is approximately thirty-six inches. The length 96 (FIG. 6) of the basin system 10, measured along the bottom 93 thereof and measured from the fluid entrance channel 34 opening to the fast out opening 20, is approximately forty-nine inches and the width 98 (FIG. 7) of the basin system 10 measured at the top thereof is approximately forty-seven inches. The height 100 (FIG. 6) of the fast out opening 20 from the bottom 93 of the basin system 10 is approximately eighteen inches. The height 102 (FIGS. 6 and 8) of the fluid entrance channel 34 from the bottom 93 of the basin system 10 is approximately sixteen inches and the distance 104 (FIG. 8) from the weir 32 to the floor 40 of the fluid entrance channel 34 measured at the wall 18 is approximately fourteen inches. As shown in FIG. 9, the width 86 of the fluid entrance channel 34 near the floor 40 is approximately three inches while the width 88 of the fluid entrance channel 34 near the weir 32 is approximately four inches. As shown in FIG. 7, the width 110 of the prerotation basin 16 measured at the bottom 84 thereof is approximately sixteen inches and the bottom 84 of the prerotation basin 16 extends a distance 112 of approximately twelve inches below the fast out opening 20. The angle 114 of slope of the fluid entrance channel 34 floor 40, as shown in FIG. 8, may be anywhere from about five degrees to about twenty degrees, depending on the size of the basin system 10, but is illustrated as having an angle of eleven degrees.

When the basin system 10 of the present invention is shipped to a wet well site, the fast out structure 24 and the pump 44 are secured to the fast out opening 20 of the basin system 10 and the basin system 10 is lowered into the hole 48 until it reaches the bottom 46. The hole 48 does not need to be drained of water prior to placement of the basin system 10. The existing hole 48 may be lined with concrete, may have a concrete floor 46 only, or may be devoid of any concrete structure. Alternatively, a pedestal of solid material, such as concrete, may be lowered into an unlined hole, and the basin system 10 is then lowered into position on the pedestal. The basin system 10 does not need to be anchored to any structure in the hole 48.

As fluid, typically water, fills the hole 48, or wet well, and extends above the height of the weir 32, the pump 44 acts as a conventional suction pump to remove fluid through the discharge pipe 58. When the fluid level drops and approaches the level of the height of the weir 32, the surrounding hole 48 acts as a forebay to the fluid entrance channel 34 and fluid is directed about the weir 32 and toward the fluid entrance channel 34. The fluid entering the prerotation basin 16 at an angle causes prerotation of the fluid in the basin system 10 and the pump 44 is able to handle the flow of fluid at a lower, and more efficient, pumping rate.

The precast prerotation basin of the present invention may be used in any wet well application and in virtually any area or situation. Thus, reference herein to specific details of the illustrated embodiments is by way of example and not by way of limitation. It will be apparent to those skilled in the art that many modifications of the basic illustrated embodiments may be made without departing from the spirit and scope of the invention as recited by the claims.

What is claimed is:

1. A precast prerotation basin system for use in a wet well comprising:

a prefabricated, three-dimensional body;

a prerotation basin formed in said three-dimensional body and sized to receive the inlet of a pump;

a fluid entrance channel formed in said three-dimensional body and positioned to deliver fluid to said prerotation basin; and transport structure formed in said three-dimensional body to facilitate movement of said prefabricated, three-dimensional body.

2. The precast prerotation basin system of claim 1 wherein said fluid entrance channel is positioned at an angle to said prerotation basin to deliver fluid tangentially to said prerotation basin.

3. The precast prerotation basin system of claim 2 wherein said fluid entrance channel further includes a sloping floor which slopes downwardly toward said prerotation basin.

4. The precast prerotation basin system of claim 3 wherein said fluid entrance channel is defined by two opposing side walls formed in said three-dimensional body, said two opposing side walls converging along the length of said fluid entrance channel to provide a narrowing passage which increases the fluid velocity of fluid passing through said fluid entrance channel toward said prerotation basin.

5. The precast prerotation basin system of claim 1 further comprising a weir surrounding, at least in part, said prerotation basin.

6. The precast prerotation basin system of claim 5 wherein said transport structure is a fast out opening sized to receive a fast out structure for positioning a pump in said prerotation basin.

7. The precast prerotation basin system of claim 1 wherein said prefabricated, three-dimensional body is formed with a fillable void for inserting ballast material.

8. The precast prerotation basin system of claim 7 further comprising an aperture formed in the prefabricated, three-dimensional body in communication with said fillable void for inserting ballast material therethrough.

9. A precast prerotation basin system for use in a wet well comprising:

a prefabricated, three-dimensional body having a substantially continuous, upstanding wall surrounding a prerotation basin sized for receiving the fluid inlet of a centrifugal pump;

a fluid entrance channel formed in said substantially continuous, upstanding wall, said fluid entrance channel being defined by two opposing side walls which comprise an extension of said upstanding wall; and a transport structure formed in said upstanding wall providing means for manipulating and moving said prefabricated, three-dimensional body.

10. The precast prerotation basin system of claim 9 wherein said fluid entrance channel is positioned tangentially to said prerotation basin to deliver fluid to said prerotation basin at an angle.

11. The precast prerotation basin system of claim 10 wherein said fluid entrance channel includes a floor which is sloped downwardly toward said prerotation basin.

12. The precast prerotation basin system of claim 11 wherein said side walls defining said fluid entrance channel converge toward each other as said fluid entrance channel extends toward said prerotation basin to provide a narrowing of said fluid entrance channel.

13. The precast prerotation basin system of claim 12 wherein said side walls are angled inwardly and downwardly to provide the fluid entrance channel with a smaller width near said floor of said fluid entrance channel than the width of said fluid entrance channel near the top of said side walls.

14. The precast prerotation basin system of claim 9 wherein said upstanding wall provides a weir positioned about said prerotation basin.

15. The precast prerotation basin system of claim 9 wherein said transport structure comprises a fast out opening sized for receiving a fixed structure therein to position a pump in said prerotation basin.

16. The precast prerotation basin system of claim 9 further including a platform having adjustable legs for levelling said precast prerotation basin in a wet well.

* * * * *